US006508239B2

(12) United States Patent
Shimada et al.

(10) Patent No.: US 6,508,239 B2
(45) Date of Patent: Jan. 21, 2003

(54) IGNITION COIL DEVICE FOR ENGINE

(75) Inventors: Junichi Shimada, Mito (JP); Eiichiro Shimada, Hitachinaka (JP); Manabu Hashimoto, Hitachinaka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 10/132,155

(22) Filed: Apr. 26, 2002

(65) Prior Publication Data

US 2002/0121954 A1 Sep. 5, 2002

Related U.S. Application Data

(62) Division of application No. 09/760,753, filed on Jan. 17, 2001, now Pat. No. 6,386,189, which is a division of application No. 09/340,200, filed on Jun. 28, 1999, now Pat. No. 6,196,209.

(30) Foreign Application Priority Data

Jun. 26, 1998 (JP) ..... 10-179979

(51) Int. Cl.[7] ..... F02P 15/00; H01F 27/06

(52) U.S. Cl. ..... 123/634; 336/96; 336/198

(58) Field of Search ..... 123/634, 635; 336/92, 96, 196, 198

(56) References Cited

U.S. PATENT DOCUMENTS 4,658,799 A * 4/1987 Kusaka et al. ..... 123/634
5,977,856 A * 11/1999 Maekawa et al. ..... 336/96

FOREIGN PATENT DOCUMENTS

| | | | |
|---|---|---|---|
| EP | 382557 | * | 8/1990 |
| JP | 9-17662 | | 1/1997 |
| JP | 9-167709 | | 6/1997 |
| JP | 10-149934 | | 6/1998 |

* cited by examiner

*Primary Examiner*—Tony M. Argenbright
(74) *Attorney, Agent, or Firm*—Crowell & Moring LLP

(57) ABSTRACT

An individual ignition type ignition coil device for engine which is directly connected to each spark plug for use, comprises a coil case 6, and a center core 1, a secondary coil 3 wound on a secondary bobbin 2 and a primary coil 5 wound on the primary bobbin 4 each concentrically installed inside the coil case 6 in turn from the inside to the outside. Insulating resin 17, 8 is filled between the interiorly installed structural members. The secondary bobbin is made of material of modified PPO mixed with inorganic matter of 30% or more.

2 Claims, 2 Drawing Sheets

IGNITION COIL DEVICE FOR ENGINE

This application is a divisional of application Ser. No. 09/760,753, filed Jan. 17, 2001 now U.S. Pat No. 6,386,189, which is, a divisional of application Ser. No. 09/340,200, filed Jun. 28, 1999, now U.S. Pat. No. 6,196,209.

BACKGROUND OF THE INVENTION

The present invention relates to an individual ignition type ignition coil device for internal combustion engine, which is provided for each spark plug and directly connected to each spark plug for use.

In recent years, an individual ignition type ignition coil device for engine which is inserted in a plug hole of the engine and individually and directly connected to each plug is being developed. This kind of ignition coil device does not need a distributor, as a result, the ignition device does not cause drop of energy supplied to an spark plug due to the distributor, high voltage cords, etc. Further, since the ignition coil can be designed without considering the drop of ignition energy, the ignition coil is evaluated as a device that it is possible to make the ignition coil small in size by reducing the coil volume and improve a part installation space of an engine room by exclusion of the distributor.

Of such individual ignition type ignition coil devices, an ignition coil device of type in which at least a part of a coil portion is inserted in a plug hole and installed is called a plug hole interior equipped type. Further, since the coil portion is inserted in the plug hole, it is made long and slender like a pencil shape and called a pencil coil, and a center core (which is a magnetic path of an iron core, and a lamination of a lot of silicon steel sheets), a primary coil and secondary coil are inserted inside a long and slender cylinder type coil case. The primary coil and secondary coil are wound around bobbins, respectively, and the bobbins are arranged concentrically with the center core. Inside the coil case containing such primary and secondary coils, insulating resin is injected and hardened or insulating oil is sealed, thereby to secure insulation. As relevant prior arts, for example, JP A 8-255719, JP A 9-7860, JP A 9-17662, JP A 8-93616, JP A 8-97057, JP A 8-144916, JP A 8-203757 and JP A 9-167709 are raised.

Of this kind of individual ignition type ignition coil devices, an ignition coil device of type in which insulating resin such as epoxy resin is injected into the coil case and hardened does not need to take countermeasures to sealing of oil as in the insulating oil sealing, further, components such as the center core, bobbins, coils, etc. can be fixed only by immersing them into the insulating resin, so that it is evaluated as a device that the fixing of those parts is simple compared with the insulating oil sealing type and it is possible to simplify the whole device and facilitate its handling.

However, since the insulating resin injected (filled in) between components of the ignition coil device has thermal stress (heat shock) applied thereon on the basis of difference in linear expansion coefficient between the components, it is necessary to take countermeasures to cracking due to heat shock and boundary separation between the components. Particularly, the individual ignition type ignition coil device of type in which it is inserted in a plug hole of the engine is exposed to a severe temperature condition (−40° C. to −130° C.) and the insulating resin is necessary to resist the heat shock.

Occurrence of cracks causes the following dielectric breakdown. For example, in the case of a type in which a centr core, secondary coil and primary coil are equipped inside in turn (in the case of a so-called inside secondary coil structure), when an air gap occurs by the crack between the secondary coil and the center core and between the secondary coil and the primary coil, where potential difference exists, so-called electric filed concentration that field intensity becomes extremely large occurs and dielectric breakdown occurs.

SUMMARY OF THE INVENTION

An object of the present invention is to reduce thermal stress applied on a secondary coil and increase the strength of a bobbin itself by adjusting a compounding ratio of bobbin material composing a coil portion of an ignition coil and a quantity of filler contained in the bobbin material, as a result, to improve insulation by preventing the bobbin from cracking and taking countermeasures to boundary separation between members, in even an individual ignition type ignition coil device equipped in a plug hole and exposed to a severe temperature environment.

A further object of the present invention is to satisfy requirement of making small a diameter of a so-called pencil coil type ignition device (a small cylinder shaped ignition coil device) equipped in a plug hole, while raising heat shock resistance and insulation as mentioned above.

The present invention proposes basically the following means for solving the problems in order to achieve the above objects.

That is, it is an individual ignition type ignition coil device for engine which is provided with a coil portion having a center core, a primary coil and a secondary coil each equipped concentrically in a coil case and formed by filling insulating resin between the components equipped interiorly, and, particularly, a so-called inside secondary coil structure in which a secondary coil is arranged inside the primary coil (a structure in which a center core, a secondary coil and a primary coil are arranged in a coil case from the inside in turn), characterized in that material of a secondary bobbin is modified polyphenylene oxide (hereunder, referred to as modified PPO), and inorganic matter of 30% or more is filled in the material.

According to the present invention, the following operation and effects can be expected:

Adhesion with insulating resin is excellent by making the secondary bobbin of modified PPO. Further, by filling inorganic matter of 30% or more, a thermal expansion coefficient is reduced whereby thermal stress can be reduced when thermal stress is applied, and improvement of the strength of the bobbin can be realized.

As a result, heat shock resistance of the insulating resin is remarkably raised, and crack occurrence of the insulating resin and separation thereof from the bobbin is prevented, whereby insulation in the secondary coil and between the secondary coil and other components (for example, the primary coil, center core, etc.) is raised.

Further, a mechanism of dielectric breakdown when separation and crack occur in the insulating resin will be described in detail in the section of "description of embodiment".

DESCRIPTION OF EMBODIMENT OF THE INVENTION

Figure 1A:
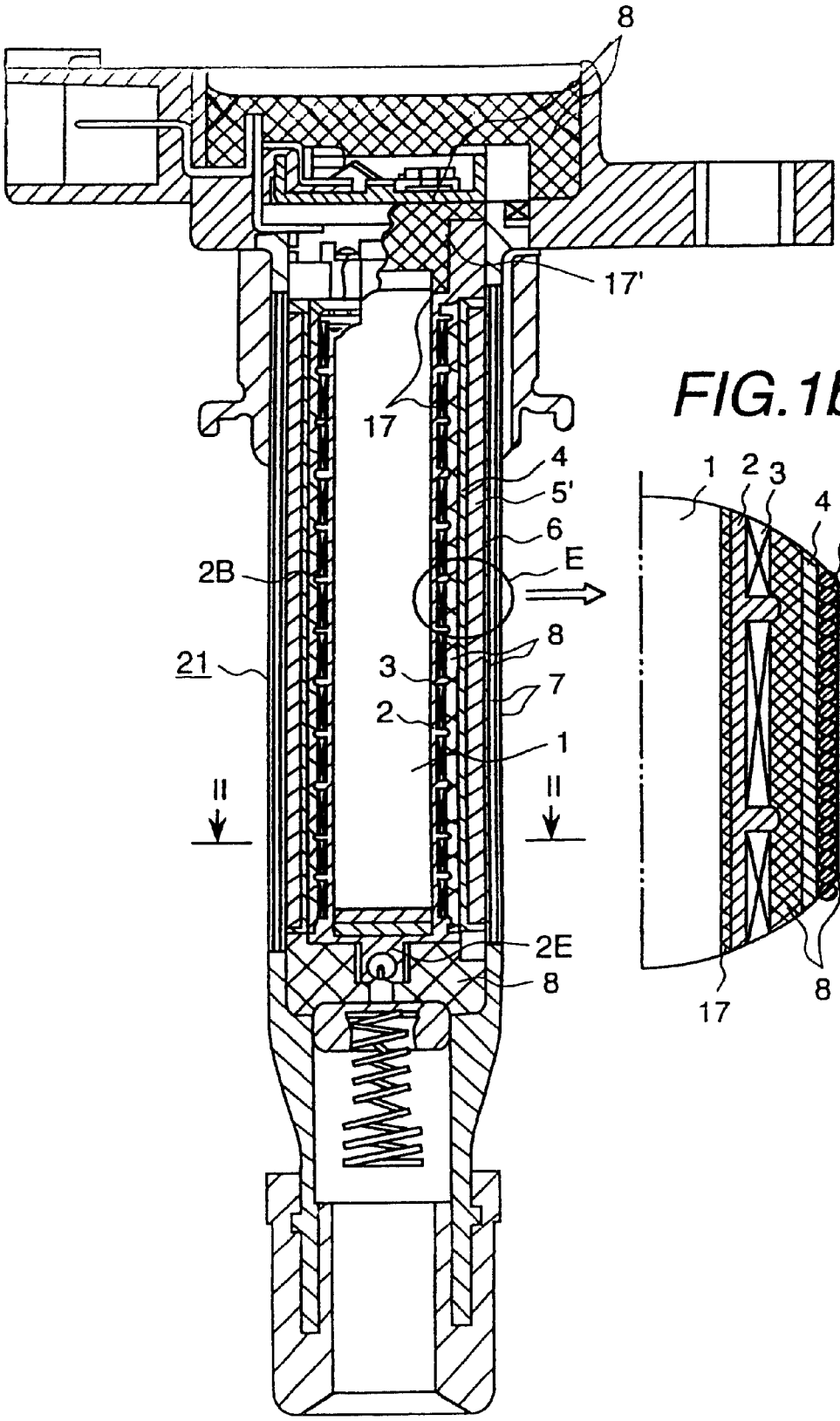
FIG. 1*a* is a vertical sectional view of an ignition coil device of an embodiment of the present invention.

An embodiment of the present invention will be described hereunder, referring to the drawings.

An ignition coil device of an embodiment of the invention will be explained, referring to FIGS. 1*a* to 3.

Figure 1B:
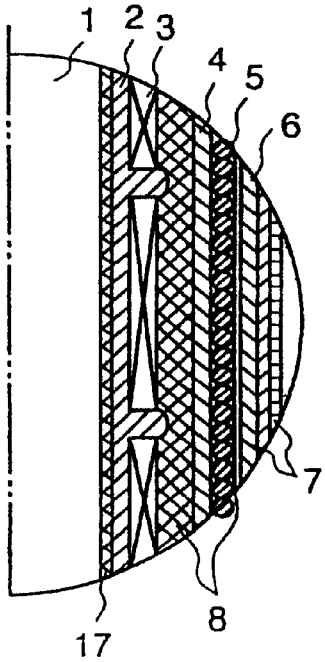
FIG. 1*b* is an enlarged view of an E portion thereof.
Figure 2:
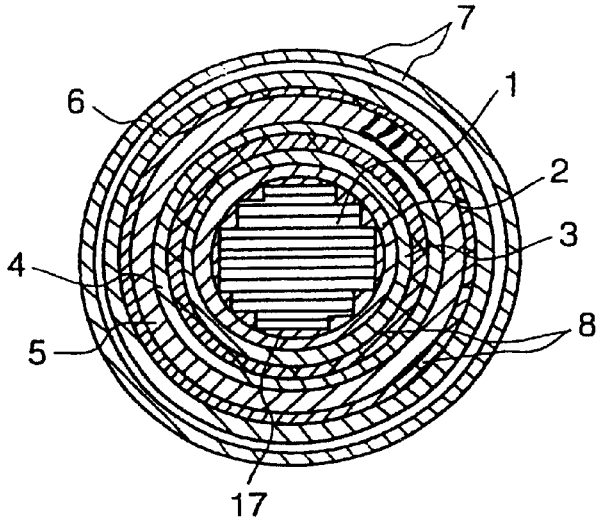
FIG. 2 is a sectional view taken along II—II of FIG. 1.

FIGS. 1*a* and 1*b* show a sectional view of an ignition coil device 21 and a part E enlarged, respectively. FIG. 2 shows a sectional view taken along a line II—II of FIG. 1.

Inside a slender and long cylindrical coil case (exterior case) 6, a center core 1, a secondary bobbin 2, a secondary coil 3, a primary bobbin 4 and a primary coil 5 are arranged from the center (the inside) to the outside in turn.

In a gap between the center core 1 and the secondary bobbin 2, so-called soft epoxy resin (elastic epoxy) 17 is filled, and epoxy resin 8 is filled between respective components of the secondary bobbin 2, secondary coil 3, primary bobbin 4, primary coil 5 and coil case 6.

Here, the soft epoxy resin 17 has a glass transformation point of normal temperature (20° C.) or less, and under the temperature higher than the glass transformation point, it has an elastic and soft property.

A reason that the soft epoxy resin 17 is used for insulation between the center core 1 and the secondary bobbin 2 is that since in addition to exposure of the plug hole inside installation type individual ignition type ignition coil device (pencil coil) to a sever temperature environment (stress of about −40° C. to 130° C.), a difference between the thermal expansion coefficient ($13\times10^{-6}$ mm/°C.) of the center core 1 and the thermal expansion coefficient ($40\times10^{-6}$ mm/°C.) of the epoxy resin is large, in the case where usual insulating resin (epoxy resin composition harder than the soft epoxy resin 17) is used, there is the fear that crack occurs in the epoxy resin by heat shock and dielectric breakdown occurs. That is, in order to take countermeasures to such heat shock, the soft epoxy resin 17 having elasticity excellent in shock absorption and an insulation property is used.

The soft epoxy resin 17 has a glass transformation point Tg satisfying a condition of {allowable stress $\sigma_0$ of the secondary bobbin 2>stress $\sigma$ occurred at (a glass transformation point Tg of the soft epoxy resin 17, −40° C.)}. Here, as an example, soft epoxy resin 17 having a glass transformation point of Tg=−25° C. is raised.

For example, in the case where the glass transformation point Tg of soft epoxy resin 17 is −25° C., when the secondary bobbin 2 is disposed in an environment in which the temperature changes from 130° C. to −25° C. and shrinks due to a temperature drop after an operation is stopped, the shrinkage of the secondary bobbin 2 is allowed by absorption due to elasticity of the soft epoxy resin 17 within a range of 130° C. to −25° C., so that the secondary bobbin 2 has substantially no stress applied thereon. In a temperature range of −25° C. to −40° C., the soft epoxy resin 17 transforms to a glass state, whereby shrinkage (deformation) of the secondary bobbin 2 is prevented, so that thermal stress ($\sigma=E\times\epsilon E=E\times\alpha\times T$) occurs in the secondary bobbin 2, wherein E denotes Young's modulus, $\epsilon$ denotes strain, $\alpha$ denotes a thermal expansion coefficient of the secondary bobbin and T denotes a temperature change (temperature difference). In the case where the allowable stress $\sigma_0$ is larger than occurred stress $\sigma$ ($\sigma<\sigma_0$), the secondary bobbin 2 is not broken.

Here, it is usual to select material of the secondary bobbin 2 which has good adhesion with epoxy resin 8. In a case where it does not have good adhesion with the epoxy resin 8, separation occurs between the secondary bobbin 2 and the epoxy resin 8 and there is the fear that dielectric breakdown occurs.

Here, a mechanism of dielectric breakdown in the case where separation (including crack of insulating resin) occurred between the insulating resin and the bobbin will be explained, referring to FIG. 3.

Figure 3:
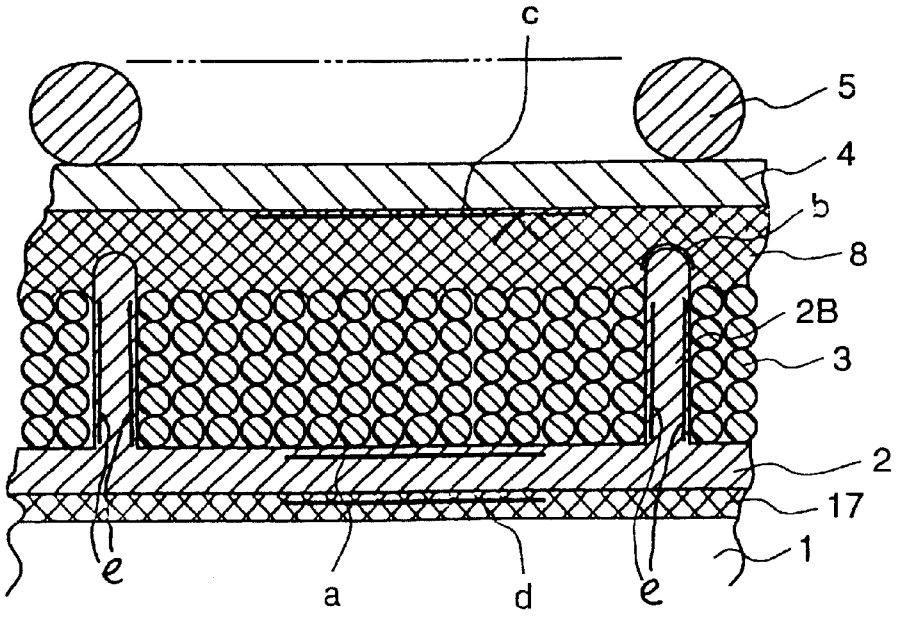
FIG. 3 is a sectional view showing a mechanism of dielectric breakdown when separation occurs in the insulating resin adhered to a primary bobbin and a secondary bobbin.

FIG. 3 is an enlarged sectional view of a part of a pencil coil of secondary coil structure, in the case where a plurality of flanges 2B for separately winding the secondary coil 3 are arranged axially on an outer peripheral surface of the secondary bobbin 2 at axial intervals.

Of the epoxy resin 8 used for various portions, the epoxy resin 8 filled between the secondary bobbin 2 and primary bobbin 4 is injected by resin injection (vacuum injection) penetrates among wires of the secondary coil 3 in addition between the secondary coil 3 and primary bobbin 4 and reaches to the outer surface of the secondary bobbin 2. Further, soft epoxy resin 17 is filled between the center core 1 and the secondary bobbin 2.

In this case, when the adhesion strength of the insulating resin to the secondary bobbin, primary bobbin is weak, separation may occur between the secondary bobbin 2 and the insulating resin 8 penetrated in the secondary coil 3, as shown by reference symbol<u>a</u> and<u>e</u>, and between the secondary bobbin flanges 2B and the insulating resin 8 as shown by reference symbol b. Further, it is considered that separation may occur in regions between the insulating resin 8 and the primary bobbin 4 as shown by reference symbol c and between the insulating resin 17 and the secondary bobbin 2 as shown by reference symbol<u>d</u>.

When separation occurred at the position shown by reference symbol<u>e</u>, field concentration due to line voltage occurs through the separated portions (air gaps), partial discharge occurs between wires of the secondary coil 3 which is followed by heat generation, and enamel coats of the coil wires are burnt out to cause layer short. Further, when separation occurs at a position shown by reference symbol<u>b</u>, field concentration occurs between wires between adjacent separated winding areas and layer short due to partial discharge in the same manner as the above occurs. When separation occurs at the position shown by reference symbol<u>c</u>, dielectric breakdown occurs between the secondary coil 3 and the primary coil 5, and when separation occurs at the position shown by reference symbol <u>a</u> and<u>d</u>, dielectric breakdown occurs between the secondary coil 3 and the center core 1.

In the present embodiment, modified PPO which is excellent in adhesion with epoxy resin is used as material of the secondary bobbin 2. Generally, the material has inorganic matter of 20% (glass filler, etc.) mixed therewith in order to secure the strength, however, in the present embodiment, inorganic matter of 30% or more is mixed to realize reduction of thermal stress $\sigma$, that is, reduction of a thermal expansion coefficient $\alpha$, and increase of the allowable stress $\sigma_0$. Further, in order to secure injection molding of the secondary bobbin 2, it is necessary to increase the fluidity of the resin under a molten condition, and the organic matter contains nonfiber inorganic matter of 10% or more such as mica, talc, calcium carbonate.

Here, in order to secure the strength of the secondary bobbin 2, it is a matter of course that it is better for the strength to be thick in thickness. However, since the pencil coil necessary to be inserted in a slender plug hole of diameter of about 23 to 25 mm in general, an outer diameter of the coil portion becomes about 24 mm. Inside this narrow space, it is necessary to fill epoxy resin 8 in the coil case 6, primary coil 5, primary bobbin 4, secondary coil 3, secondary bobbin 2, center core 1 and air gaps therebetween without defects such as voids. Therefore, it is desirable to make the thickness of each portion extremely thin.

In the present embodiment, the secondary bobbin 2 has material of modified PPO mixed with inorganic matter of 40% and thickness of 1 to 1.5 mm. The bobbin 2 after temperature change of 130° C. to −40° C. is repeated 300 times is observed, as a result, it is found that no damage occurs on the secondary bobbin 2 and it is confirmed that soundness thereof is maintained. That is, it is confirmed that the allowable stress $\sigma_0$ of the secondary bobbin 2 is larger than the occurred stress $\sigma$.

The inorganic matter 40%-containing modified PPO has a thermal expansion coefficient which is about $50\times10^{-6}$ mm/°C. in a range of −30° C. to 100° C. in directions including a flow direction when molded and a perpendicular direction thereto. General inorganic matter 20% containing modified PPO has a thermal expansion coefficient of about $80\times10^{-6}$ mm/°C. at maximum, thermal stress as large as 1.5 times or more the stress in the material of the present embodiment occurs. Further, the secondary coil 3 wound around the secondary bobbin 2 has a linear expansion coefficient of about $60\times10^{-6}$ mm/°C. at maximum under the condition the epoxy resin 8 is impregnated with epoxy resin 8 between copper wires of the coil, and the thermal expansion coefficient has almost no difference to the secondary bobbin 2, stress occurring on a boundary between the secondary bobbin 2 and the secondary coil is small and there is no concern about separation.

Main operation and effects of the present embodiment are as follows.

Even in the individual ignition type ignition coil device inserted in the plug hole and exposed to a sever temperature environment, it is possible to make the thickness of the secondary bobbin thin and realize to make the outer diameter of coil small by making the secondary bobbin 2 of modified PPO which is excellent in adhesion with the epoxy resin 8 and filling inorganic matter of 30% or more. Further, since the thermal expansion coefficient is smaller than conventional one, thermal stress caused by heat shock can be reduced, thermal chock resistance is improved more than conventional one, it is possible to improve insulation by prevention of crack in the secondary bobbin and prevention of separation from the insulating resin.

Here, in order to effect increase of an area occupied by the center core 1 and increase of output following it as much as possible under the restriction that the ignition coil device is made small in size (small in diameter), it is necessary for the bobbin material to select such resin that it is possible to mold the bobbin in thin thickness, polyphenylene sulfide (hereunder, referred to as PPS) is excellent in fluidity when molded and advantageous for making the thickness thin without losing the fluidity even if a compounding ratio of the inorganic matter is 50 wt. % or more. In the case where PPS is used for the primary bobbin, in order to make a thermal expansion coefficient of metal of the coil portion close to that of the bobbin, inorganic matter is compounded by 50 to 70 wt %, as a result, the linear expansion coefficient at a temperature of from a normal temperature (20° C.) to 150° C. is in a range of $(10 \text{ to } 45)\times10^{-6}$ mm/°C. in directions including a flow direction when molded and a perpendicular direction. The thickness is necessary to be 0.5 mm or more due to restriction in molding and it is realized to make the thickness thin, that is, 1 mm or less. Because its linear expansion coefficient is closer to that of metal, thermal stress occurred when heat shock is applied is small, therefore, it is possible to improve insulation by effecting prevention of crack in the insulating resin and prevention of separation from the insulating resin.

According to the present invention, by improving the strength of bobbin of a so-called pencil type coil, and increasing heat shock resistance by reducing thermal stress, even for an individual ignition type coil device inserted in a plug hole and exposed to a sever temperature environment, it is possible to effect prevention of crack and improvement of insulation of insulating resin.

Further, the present invention can satisfy requirement of a so-called pencil type (slender cylindrical ignition coil device) inserted in a plug hole while raising the above-mentioned heat shock resistance and insulation.

What is claimed is:

1. A cylindrical ignition coil device for an individual ignition internal combustion engine, comprising:

a center core made of a magnetic material;

a secondary coil composed of a secondary bobbin made of resin, having a slender and cylindrical shape and containing therein said center core, and a secondary winding of the ignition coil, wound around an outer periphery of said secondary bobbin;

a primary coil composed of a primary bobbin made of resin, having a slender and cylindrical shape and containing therein said secondary coil, and a primary winding of the ignition coil, wound around an outer periphery of said primary bobbin;

a coil case made of resin and containing therein said center core, secondary coil and primary coil; and wherein said primary bobbin has a thickness of 1 mm or less and is made of polyphenylene sulfide (PPS) containing 50–70 wt. % inorganic matter.

2. A cylindrical ignition coil device according to claim 1, wherein the linear expansion coefficient of said primary bobbin at a temperature from normal temperature (20° C.) to 150° C. is in a range of $(10 \text{ to } 45)\times10^{-6}$ mm/°C.

* * * * *